United States Patent [19]

Bucher

[11] Patent Number: 4,566,443

[45] Date of Patent: Jan. 28, 1986

[54] AIR BUBBLE HYDROMASSAGING APPARATUS

[75] Inventor: Heinz Bucher, Rottweil, Fed. Rep. of Germany

[73] Assignee: Metronic Electronic GmbH, Rottweil, Fed. Rep. of Germany

[21] Appl. No.: 584,513

[22] Filed: Feb. 28, 1984

[30] Foreign Application Priority Data

Mar. 26, 1983 [DE] Fed. Rep. of Germany ..... 3311103

[51] Int. Cl.[4] ..... A61H 9/00

[52] U.S. Cl. ..... 128/66; 312/209; 312/235 R

[58] Field of Search ..... 128/66, 65; 312/235 R, 312/209; D6/429, 430, 432, 440, 445, 448; 4/630

[56] References Cited

U.S. PATENT DOCUMENTS

D. 130,607 12/1941 Ahrens ..... D6/448

D. 144,591 4/1946 Schutes ..... 312/235 R 1,409,330 3/1922 Aper ..... 312/235 R 3,280,458 10/1966 Deeley, Jr. et al. ..... 312/209

3,597,033 8/1968 Slouka ..... 312/209

*Primary Examiner*—Robert Peshock

*Assistant Examiner*—Cary E. Stone

*Attorney, Agent, or Firm*—Thomas W. Speckman

[57] ABSTRACT

An air bubble hydromassaging apparatus has a housing adapted to be utilized also as a seat and closed by a cover, which holds a foldable air bubble grid, an air hose and a control unit including a blower, a heater and control members. The control unit is in the form of a separate structural unit so that it may be inspected, tested and serviced individually. The housing is provided with at least one vertical side wall with a recessed compartment into which the separate control unit is placed. The control members of the control unit are disposed on an exposed panel in the upper portion of the control unit.

23 Claims, 2 Drawing Figures

AIR BUBBLE HYDROMASSAGING APPARATUS

BACKGROUND OF THE INVENTION

1. Field of the Invention

This invention relates to an air bubble hydromassaging apparatus comprising a housing adapted to be utilized as a seat which is closed by a cover and accommodates the foldable air bubble mat, the air hose and the control unit including the blower, the heater and the controls.

2. Description of the Prior Art

An air jet massaging apparatus of this general type is known from U.S. Pat. No. 3,267,936. This prior device has the advantage that the bubble mat and the air hose are stored next to the control unit. The housing, capable of being used as a seat, encloses and protects all components of the air jet massaging apparatus and yet is compact enough so that there is room for it in a small bathroom.

In this known air jet massaging apparatus, the housing is divided by a horizontal partition into a lower chamber and an upper chamber. The lower chamber holds the blower and other functional units. The controls are located on the partition wall. The upper chamber is for storing the disassembled bubble grid and the air hose and is closed by a cover. This prior air jet massaging apparatus is not easy to operate because the controls are accessible only when the cover is open. Moreover, they are arranged considerably below the upper edge of the housing. This is a serious drawback for the user lying in the bathtub because he must raise himself up to reach the controls at all. Moreover, this particular construction of an air bubble hydromassaging apparatus fails to meet the safety standards for devices of this kind. In addition, considerable installation work needs to be done with this housing. The control unit is accessible only after disassembly and is difficult to check and service separately.

SUMMARY OF THE INVENTION

It is an object of the present invention to provide an air bubble hydromassaging apparatus of the general type referred to in the foregoing, in which the control unit, for reasons of safety, is in the form of a self-contained structural unit which can be separately tested and monitored, while the housing is adapted to contain the control unit simply and conveniently, requiring no installation work, and providing room to store the air bubble grid and the air hose when not in use.

To achieve the objects of this invention, the housing is provided on at least one vertical side wall with a recessed compartment into which the control unit, a separate structural unit, is placed. The control members of the control unit are disposed in the upper region of a panel portion which is exposed to view. In that way, a storage compartment is created in the housing for the separate control unit. It is thus possible to manufacture the control unit individually so that it complies with the applicable safety regulations and can be tested separately before it is used and placed in the recessed compartment in the massaging apparatus housing provided for it. There is enough room for the folded air bubble grid and the air hose in the remainder of the housing and, additionally, the housing may be used as a seating facility.

To create sufficient space for the control unit in the housing, the housing according to one embodiment is in the shape of a rectilinear box with the recessed compartment being provided in a vertical side wall of the housing.

In order for the housing and the control unit to form a compact unit, the configuration is preferably such that the control unit side walls, when the control unit is placed in the recessed compartment of the housing, are flush with the housing side walls.

A simplified and entirely adequate compartment for the control unit is provided according to another embodiment in that the recessed compartment is open both in front and on a portion of each side, is closed at the bottom by a bottom plate, and is confined at the top by an overhanging portion of the housing.

To prevent the control unit from inadvertently becoming dislodged from the compartment in the housing, another embodiment provides for the control unit to be securely attached within the compartment. For this purpose it has been found easiest to secure the control unit to the housing floor by means of screws.

To facilitate access to the control members of the control unit, another embodiment is characterized by the control unit being in the shape of a rectilinear box with its uppermost portion being in the form of a console, that the exposed front of the console is inclined to form an obtuse angle with the adjacent front wall of the control unit and the inclined portion constitutes the control panel having the control members thereon, and that the overhanging housing portion conforms to the contour of the console of the control unit.

According to one embodiment which has been found particularly advantageous, the socket for connecting the air hose to the compressed air outlet of the blower is located on the control panel so that the large side expanses of the control unit remain closed.

The installation of the control unit is facilitated in that the control panel, including the affixed control members, is in the form of a separate structural component which can be easily joined to the console of the control unit.

Use of the housing as a seat is facilitated in that the housing top, above the control unit, takes the shape of a seat which is fixedly joined to the housing and merges by way of an inclined transitional section with the front of the overhanging housing portion, and the balance of the housing top is covered by means of a cover member. The seat is thus an integral component of the housing and is prevented from inadvertently becoming loose or detached, which factor contributes to the outstanding safety of the device according to this invention. The cover, when lifted, exposes the interior of the housing. Access to the interior is aided by the top edge of the housing in the area of the cover forming a receptacle into which the turned down side portions of the cover member are fit. Thus, to gain access to the housing interior, the cover need only be lifted off, yet while in the closed position, the cover is securely attached to the housing.

According to another embodiment, the seat is formed of individual elongate bars which are fastened to the housing and completely or partially cover the open housing top in the area of the seat. Wooden boards have been found to be suitable for this purpose.

The production costs of the housing may be kept low because the floor panel, or bottom plate, the overhang and the transitional section are molded in one piece with the housing, and the housing is open in the region facing the points of contact with the control unit.

Even better use of the available space is achieved according to another embodiment in which the recessed compartment for the control unit extends only across the upper portion of an open side wall of the housing, the recess is closed at the bottom by means of an intermediate partition or the like, and another recess is provided between the intermediate partition and the bottom plate to serve as a storage space for a small tub. Thus, the housing also affords space for a small tub to be stored neatly and tidily when not in use. A preferred embodiment is characterized in that the side walls of the stored tub are flush with the adjacent side walls of the control unit and the housing. Removal of the small tub from the recessed storage space in the housing is facilitated when two opposite side walls of the small tub are provided with gripping elements, such as apertures, near the upper tub rim.

BRIEF DESCRIPTION OF THE DRAWINGS

Further objects, advantages and features of the present invention will appear from the following description of embodiments illustrated in perspective views in the drawings, in which.

DESCRIPTION OF THE PREFERRED EMBODIMENTS

Figure 1:
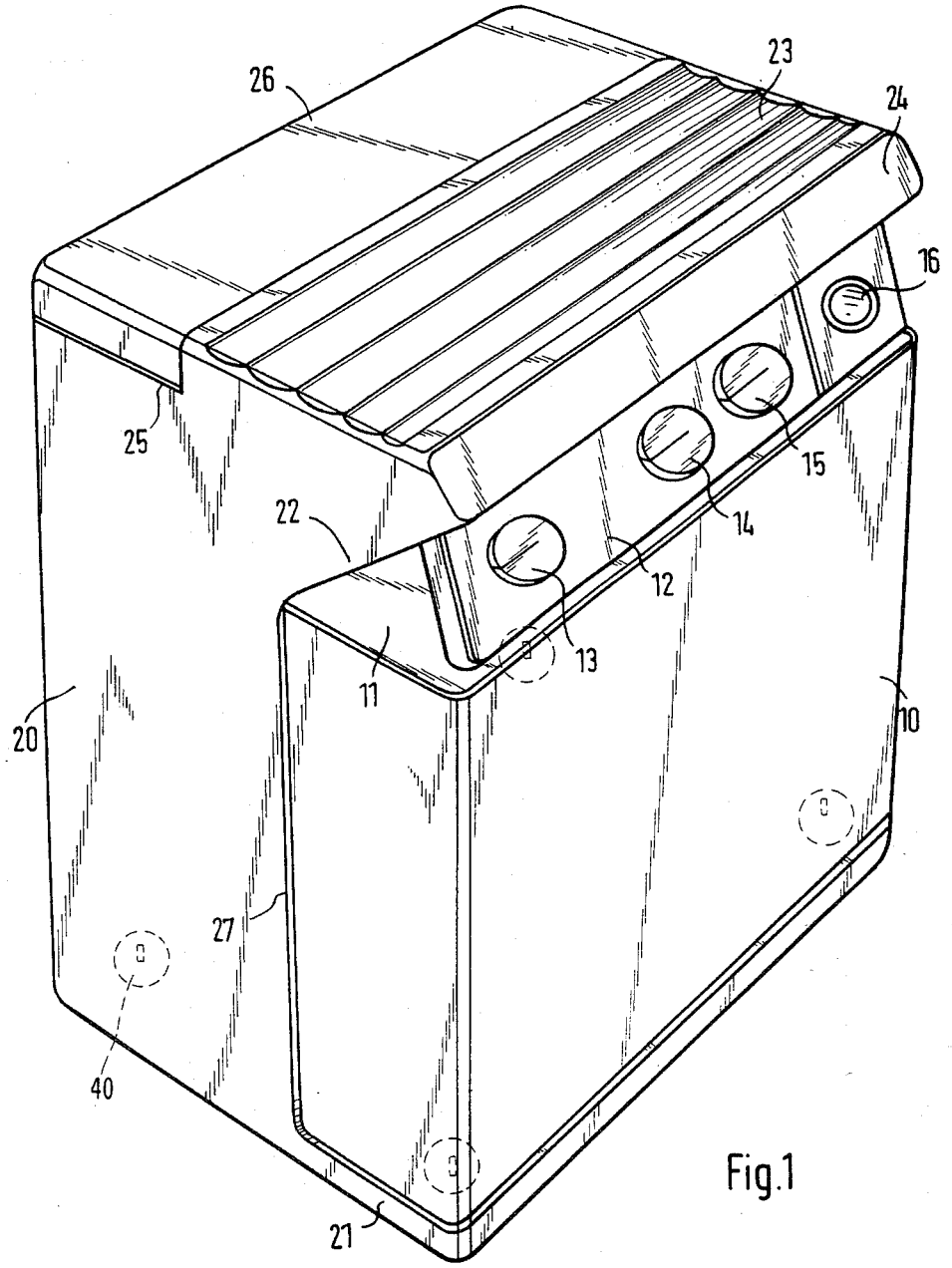
FIG. 1 shows a housing with the control unit placed therein.
Figure 2:
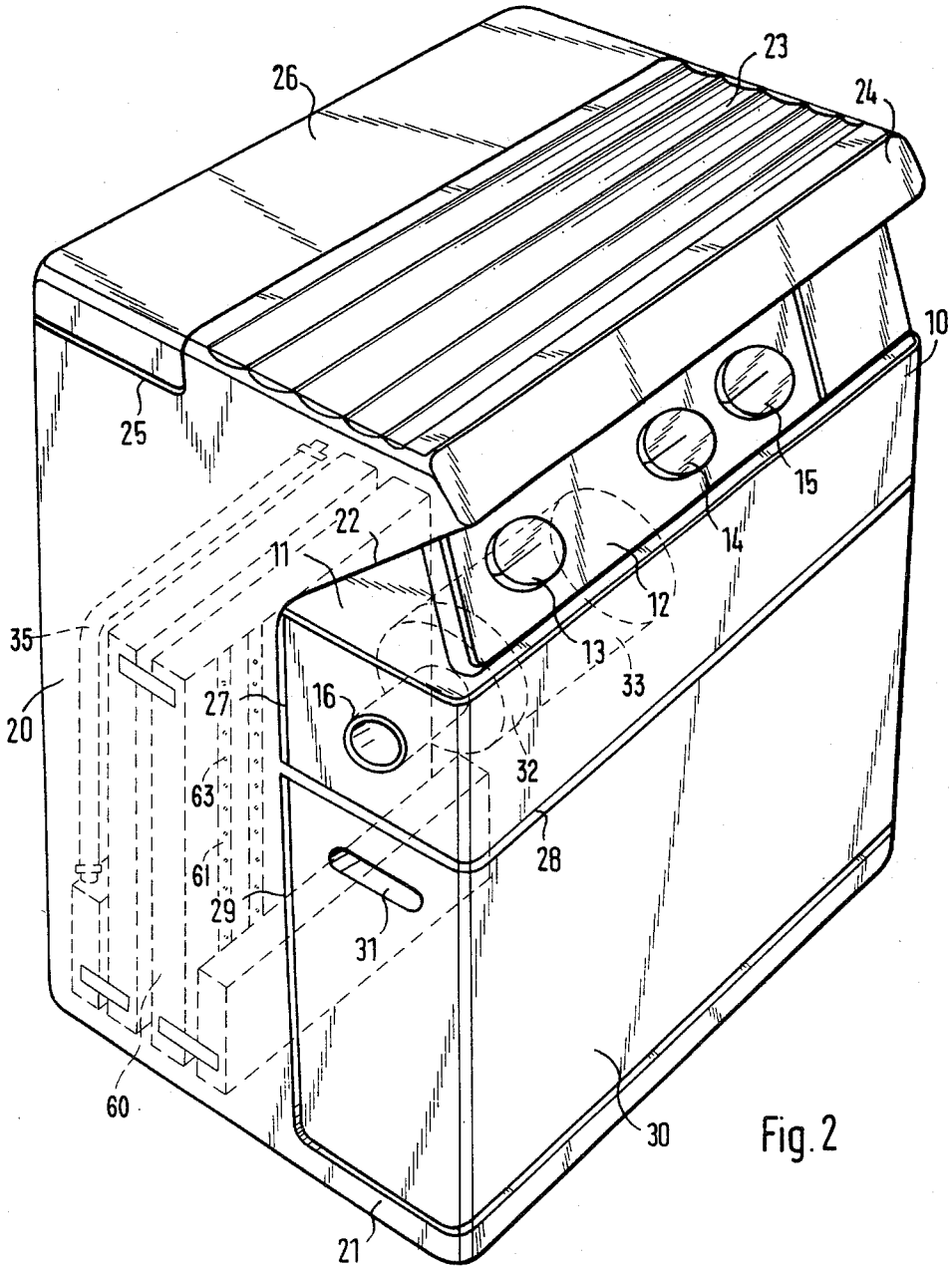
FIG. 2 shows a housing with the control unit, functional elements of an air bubble hydromassage apparatus, and a small tub stored therein.

As shown in FIGS. 1 and 2, control unit 10 is a separate structural unit which may be prefabricated and individually tested and checked. Contained inside the control unit are the blower 33, the heater 32 and other functional elements necessary to produce compressed air and to control the delivery of compressed air. Control unit 10 is subject to special safety regulations since it is operated by electric power. Control unit 10 in the illustrated embodiment is in the shape of a rectilinear box with a closed base portion in compliance with relevant safety codes. Positioned on top of the box-shaped base portion is console portion 11 which is formed in front by a panel serving as control panel 12. Control panel 12 has control members 13 to 15 thereon and also connector 16 for the air hose 35 by which the air bubble mat 60 having air channels 61 and air jet orifices 63 is connected to the blower. Inside control unit 10, connector 16 is in communication with the compressed air outlet of the blower. Control panel 12 is rearwardly inclined, forming an obtuse angle with the front wall of control unit 10. Thus, control panel 12 can be viewed better from above and control members 13 to 15 are easier to operate when the unit is placed alongside a bathtub.

Housing 20 of the massaging apparatus is likewise in the shape of a rectilinear box and may be utilized as a seat. Recessed compartment 27 is provided in the front of housing 20 which recess is closed at the bottom by floor or bottom plate 21 and at the top is defined by overhanging portion 22 of housing 20. When control unit 10 is placed in recessed compartment 27, the side walls of control unit 10 are flush with the side walls of housing 20. Overhanging housing portion 22 conforms to the contours of console portion 11 of control unit 10 and juts out somewhat above control panel 12. Inclined transitional section 24 merges into overhanging portion 22 of housing 20 and is preferably made in one piece with housing 20 and floor 21. Seat 23 may be made of individual bars or boards which completely or partially cover the portion of housing 20 adjacent to inclined transitional section 24 and which are securely attached to the housing structure. The remaining area of the open top of housing 20 is closed by cover 26 which has turned down side wall sections which fit into receptacle 25 formed in the upper portion of housing 20 wherein the top is securely retained.

Control unit 10 may be mechanically secured in recessed compartment 27 by simply being screwed to floor 21 of housing 20.

Housing 20 may require only the side walls, the back wall and floor 21 to provide the storage space in housing 20 for the folded air bubble mat 60 and the air hose 35, and the front being covered by control unit 10. This construction substantially lowers the manufacturing costs of housing 20.

As shown in FIG. 2, control unit 10 may alternatively be of a smaller size to fit into smaller recessed compartment 27 in the front portion of housing 20. Console portion 11 including control panel 12 is the same as in the embodiment of FIG. 1, as are overhanging portion 22 and inclined transitional section 24. Recessed compartment 27 is in the upper region of the front portion of housing 20 so that control members 13 to 15 again can be conveniently viewed and are easily accessible. Below recessed compartment 27 and partitioned therefrom by intermediate partition 28 is lower recessed compartment 29, with bottom plate 21 forming the base of lower recessed compartment 29. Control unit 10 may be placed on top of intermediate partition 28 and may be secured thereto. Lower recessed compartment 29 serves to store small tub 30 in a flush relationship with the adjacent side walls of control unit 10 and housing 20. The small tub may be an arm or foot bath. Small tub 30 may be retained by floor 21 and the adjoining side walls of housing 20. In order for small tub 30 to be readily taken out of lower recessed compartment 29, small tub 30 may be provided with gripping elements, such as apertures 31, near the top edge of two opposite sides. Housing 20 holding control unit 10 and small tub 30 in storage can be provided with casters 40 on the underside of floor 21 and thus made readily movable.

I claim:

1. An air bubble hydromassaging apparatus, comprising a control unit enclosing functional elements comprising a blower, a heater and having control members thereon, and a foldable air bubble grid adapted to be connected by an air hose to the compressed air outlet of said control unit, said air bubble grid having air channels and air jet orifices, all parts of said apparatus when not in use capable of being stored in a single housing, a vertical side wall of said housing being provided with a recessed compartment, said control members of said control unit being located in the upper region of said housing, and said housing having an interior compartment which is accessible from above and is adapted to be closed by a cover, characterized in that said control unit is constructed as a self-contained unit separate from said housing, that said recessed compartment in said vertical side wall of said housing is formed to serve as space into which said control unit is placed, that said control members of said control unit are disposed in said upper region of an exposed panel of said control unit placed in said recessed compartment, that an overhanging portion of the top of said housing extending over said control unit is shaped to form a seat, and that the remaining area of said housing is closed by said cover which covers the compartment for storing said air bubble grid and said air hose.

2. Air bubble hydromassaging apparatus according to claim 1, characterized in that said housing is in the shape of a rectilinear box, and that said recessed compartment is provided in a vertical front side wall of said housing.

3. Air bubble hydromassaging apparatus according to claim 2, characterized in that said recessed compartment is open both in front and on a portion of each side, is closed at the bottom by bottom plate and is confined at the top by said overhanging portion of said housing.

4. Air bubble hydromassaging apparatus according to claim 3, characterized in that said control unit is secured in said recessed compartment of said housing.

5. Air bubble hydromassaging apparatus according to claim 4, characterized in that said control unit is secured to said bottom plate of said housing.

6. Air bubble hydromassaging apparatus according to claim 5, characterized in that said control unit is in the shape of a rectilinear box with its uppermost portion being in the form of console portion, that the exposed front of said console portion is inclined to form an obtuse angle with the adjacent front wall of said control unit and comprises said control panel having said control members thereon, and that said overhanging portion conforms to the contour of said console portion of said control unit.

7. Air bubble hydromassaging apparatus according to claim 6, characterized in that connector for said air hose connecting said air bubble grid to said compressed air outlet of said blower is disposed on said control panel.

8. Air bubble hydromassaging apparatus according to claim 7, characterized in that said control panel including said affixed control members is in the form of a separate structural component which can easily be joined to said console of said control unit.

9. Air bubble hydromassaging apparatus according to claim 8, characterized in that said seat merges by way of an inclined transitional section with the front of said overhanging portion and said control unit.

10. Air bubble hydromassaging apparatus according to claim 9, characterized in that said housing in the area of said cover forms receptacle into which said cover having turned down side portions may be inserted.

11. Air bubble hydromassaging apparatus according to claim 9, characterized in that said seat comprises individual elongate bars which are fastened to said housing and cover the open top of said housing in the area of said seat.

12. Air bubble hydromassaging apparatus according to claim 11, characterized in that said bottom plate, said overhanging portion and said inclined transitional section are made in one piece with said housing.

13. Air bubble hydromassaging apparatus according to claim 12, characterized in that said housing is open in the region facing the points of contact with control unit.

14. Air bubble hydromassaging apparatus according to claim 13, characterized in that said recessed compartment for said control unit extends only across the upper portion of said vertical front wall of said housing, that said recessed compartment is closed at the bottom by means of intermediate plate, and that lower recessed compartment is provided between said intermediate partition and said bottom plate for storing small tub.

15. Air bubble hydromassaging apparatus according to claim 14, characterized in that two opposite side walls of said compact tub are provided with gripping elements for removal.

16. Air bubble hydromassaging apparatus according to claim 15, characterized in that the underside of said bottom plate of said housing has casters affixed thereto.

17. Air bubble hydromassaging apparatus according to claim 1, characterized in that said recessed compartment is open both in front and on a portion of each side, is closed at the bottom by bottom plate and is confined at the top by said overhanging portion of said housing.

18. Air bubble hydromassaging apparatus according to claim 1, characterized in that said control unit is secured in said recessed compartment of said housing.

19. Air bubble hydromassaging apparatus according to claim 1, characterized in that said control unit is in the shape of a rectilinear box with its uppermost portion being in the form of console portion, that the exposed front of said console portion is inclined to form an obtuse angle with the adjacent front wall of said control unit and comprises said control panel having said control members thereon, and that said overhanging portion conforms to the contour of said console portion of said control unit.

20. Air bubble hydromassaging apparatus according to claim 1, characterized in that said seat merges by way of an inclined transitional section with the front of said overhanging portion and said control unit.

21. Air bubble hydromassaging apparatus according to claim 1, characterized in that said bottom plate, said overhanging portion and said inclined transitional section are made in one piece with said housing.

22. Air bubble hydromassaging apparatus according to claim 1, characterized in that said housing is open in the region facing the points of contact with control unit.

23. Air bubble hydromassaging apparatus according to claim 1, characterized in that said recessed compartment for said control unit extends only across the upper portion of a vertical front wall of said housing, that said recessed compartment is closed at the bottom by means of intermediate plate, and that lower recessed compartment is provided between said intermediate partition and said bottom plate for storing small tub.

* * * * *